United States Patent [19]

Lechner et al.

[11] 3,995,183

[45] Nov. 30, 1976

[54] SPARK GAP COMPONENT FOR USE IN IGNITION SYSTEMS OF INTERNAL COMBUSTION ENGINES

[75] Inventors: Emeran Lechner, Munich; Heinz Meier, Gelting; Heinz Melcher, Munich, all of Germany

[73] Assignee: Siemens Aktiengesellschaft, Berlin & Munich, Germany

[22] Filed: Mar. 21, 1975

[21] Appl. No.: 560,604

[30] Foreign Application Priority Data

Apr. 16, 1974 Germany ..... 2418261

[52] U.S. Cl. ..... 313/124; 313/51; 313/217

[51] Int. Cl.[2] ..... H01T 13/46

[58] Field of Search ..... 313/124, 217, 49, 51

[56] References Cited

UNITED STATES PATENTS

| | | | |
|---|---|---|---|
| 3,535,582 | 10/1970 | Kawiecki | 313/217 X |
| 3,702,952 | 11/1972 | Cassidy et al. | 313/217 X |
| 3,876,894 | 4/1975 | Peche | 313/217 X |

*Primary Examiner*—R. V. Rolinec
*Assistant Examiner*—Darwin R. Hostetter
*Attorney, Agent, or Firm*—Hill, Gross, Simpson, Van Santen, Steadman, Chiara & Simpson

[57] ABSTRACT

A spark plug connector for use in ignition systems of internal combustion engines, said connector having a spark gap component in which two double offset or stepped configuration electrodes are disposed facing each other in a gas-tight discharge tube, said electrodes being electrically insulated and spaced from each other to define a discharge gap therebetween.

7 Claims, 2 Drawing Figures

SPARK GAP COMPONENT FOR USE IN IGNITION SYSTEMS OF INTERNAL COMBUSTION ENGINES

This invention relates to spark plug connectors and, more specifically, to such connectors having a pair of spaced electrodes disposed in a gas-tight discharge tube.

The use of primary spark gaps for improving the ignition reliability in coil operated ignition systems of internal combustion engines is known. In such systems a gas discharge tube is inserted in a high-voltage spark plug between the structural components which carry the ignition current. The insulating body of the gas discharge tube consists of glass, and two pin-shaped electrodes are fused into its ends.

Furthermore, it is known to incorporate such primary spark gaps in the spark plug connector as well. The electrodes, which are inserted in the glass insulating body, again have the shape of a pin or a nail head. In this connection it may be mentioned that the electrodes also may be of a plate or cup-shaped design.

In coil ignition systems, the voltage at the spark plug increases only relatively slowly until the ignition voltage at the spark plug electrodes has been reached. If the insulating body of the spark plug is contaminated, e.g., due to soot and lead residues, then electrical shunts are produced which result in a loss of ignition energy. If unfavorable cases, the voltage required to produce the spark across the spark plug electrodes, may then fail to be reached.

By incorporating a primary spark gap ahead of the spark plug, the latter is isolated from the ignition energy source until a sufficiently high voltage level of 8 to 10 kV is reached. Then, the primary spark gap connects the voltage to the spark plug. As a consequence, a steep rise in voltage occurs across the spark plug (in the order of magnitude of $10^{12}$ V/sec) so that the ignition energy does not flow across any of the shunts which may possibly exist, but instead virtually entirely across the spark plug proper. Ignition misfires, which occur mainly during acceleration and which are perceptible in the form of irregular running of the motor, are thus prevented, and an increased gas consumption is avoided. In addition to a better starting and running behavior of the motor, the ignition with a primary spark gap is also to be preferred from the environmental point of view. Due to a better combustion of the fuel, the proportion of carbon monoxide in the exhaust gas is reduced.

Technological and associated economic considerations have hitherto hindered the standard or large-scale use of primary spark gap components in ignition systms of motor vehicles.

SUMMARY OF THE INVENTION

An object of the present invention is to provide in a spark plug connector a mechanically strong spark gap component.

Another object of the present invention is to provide a spark gap component which has a high heat resistance.

Another object of the invention is to provide a spark gap component which requires a minimum of space and has a high life expectancy.

A further object of the invention is to provide a spark gap component which can easily be incorporated into the ignition systems of internal combustion engines without additional mounting of guiding elements.

Other objects and advantages of the present invention will become more apparent when considering the following description and accompanying drawings.

DESCRIPTION OF A PREFERRED EMBODIMENT

The purpose of the invention is to create a mechanically strong heat resistant spark gap component element which requires little space and which has a high life expectancy and which can be incorporated easily into the ignition systems of internal combustion engines without additional mounting or guiding elements. To achieve this purpose, considering a spark gap component of the kind initially described, it is proposed in accordance with the invention that the electrodes are formed as a graduated or stepped beaker in that the electrode has an inner and outer double offset, stepped or rabbeted configuration. This configuration creates useful inner and outer annular shoulders. The electrodes are positioned in the ends of a tubular insulator body in a gas-tight manner having their closed end portions facing or opposing each other.

The oppositely disposed closed end portions of the electrodes are suitably provided with a layer of a fireproof material, and the tubular insulating body preferably consists of ceramic.

The spark gap component according to the invention is distinguished in particular by the fact that it can be mounted preferably in spark plug sockets or connectors without additional guide elements. The outer diameter of the tubular insulating body of the primary spark gap is preferably matched to the inside diameter of the insulating body of the plug, and component parts of the plug resting on the annular shoulder are fitted into the inner stepped portions of the electrodes of the primary spark gap. Due to the stepped construction of the electrodes, the spark gap component requires little space since the two component parts adjacent to the electrodes, are fitted into these depressions. Therefore, the spark plug can be constructed very short. The structure of the primary spark gap is, therefore, optimally matched to the function and to the installation requirement in the spark plug. In this context the advantages offered by the metal-ceramic technology are particularly evident.

The stepped electrodes of the primary spark gap consist of a base material whose thermal coefficient of expansion is almost the same as that of the ceramic insulating body. The spark gap component element is suitably filled with an inert gas. Despite the minimal installed length, a sufficiently large gas chamber exists. In contrast to glass designs, the metal-ceramic primary spark gap has a considerably smaller installed length (about ⅓), and is substantially superior in terms of heat resistance, exceeding the requirements. Compared with glass designs, the heat dissipation from the electrodes is considerably more favorable.

Figure 1:
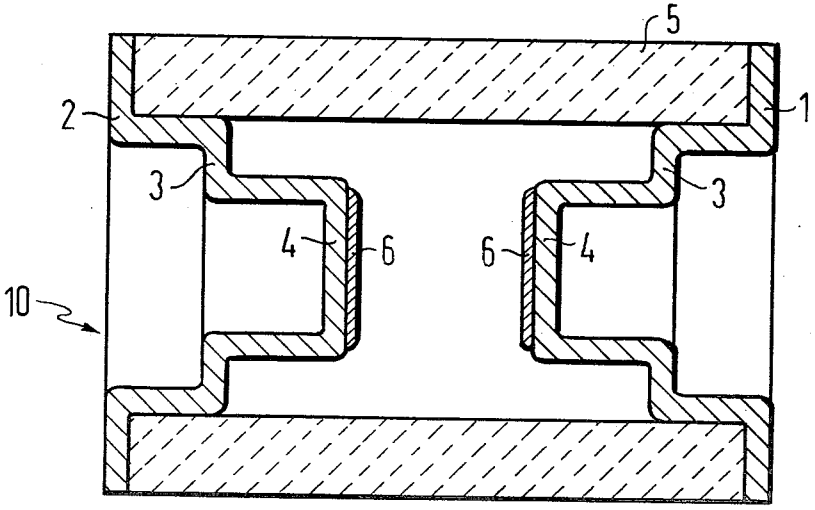
FIG. 1 illustrates a longitudinal section through a spark gap component according to the invention.

In the case of the spark gap component 10 illustrated in FIG. 1, two electrodes 1 and 2 which define a discharge gap, are inserted in a gas-tight manner in the ends of a tube-shaped insulating body 5 preferably made of ceramic. A stated above, an inert gas is used as filling gas. The electrodes 1 and 2 a double offset of stepped configuration which provides an annular shoulder 3. The electrodes constructed in this manner are inserted in the ends of a tube-shaped ceramic insulating body 5 with their closed end portions facing each other, in a gas tight manner, and the outer closed end portions are provided with a layer 6 of a fire proof material.

Figure 2:
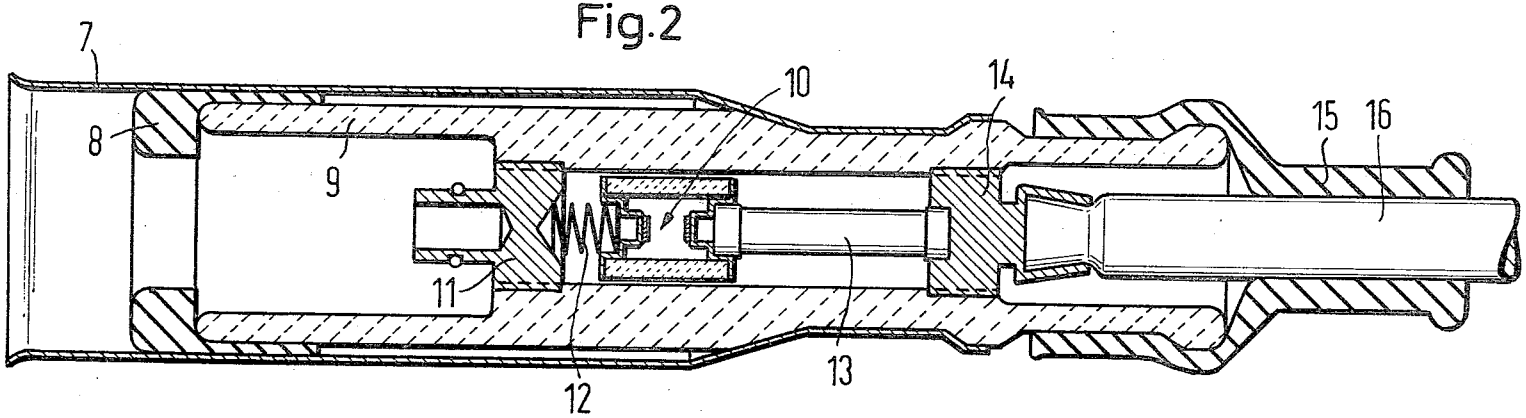
FIG. 2 illustrates a longitudinal section through a spark plug connector incorporating spark gap component in accordance with the invention.

The spark plug connector shown in FIG. 2 with a metal-ceramic spark gap component has the following structure: The contact terminal 11 makes the connection between the connector and the spark plug proper. A compression spring 12 supports the primary spark gap component 10, as well as a suppressor resistor 13 and it established an electrical connection between the contact terminal and the primary spark gap component. The compression spring is constructed in such a way that it fits into one of the inner annular shoulder of electrodes 1 or 2 of the primary spark gap 10 as well as into the bore in the contact terminal. The suppressor resistor 13 fits into the other like inner annular shoulder of electrode 1 or 2, respectively, of the primary spark gap 10 and provides the connection to the high voltage cable connection 14. The parts 11 to 14 are surrounded by an insulating body 9 which in turn is covered by a metal shield 7. The spark plug connector is provided with a plug shroud 8 at the end leading to the spark plug, and it is provided with a cable sleeve 15 at the end leading to the coil ignition system, the latter sleeve surrounding the high voltage cable 16 which is connected with the high-voltage cable connection 14. Because of the advantageous type of construction of the spark gap component, spark plug connectors with a primary spark gap can be produced which are less than 10 mm longer than conventional shielded spark plug connectors.

While a preferred embodiment of the invention has been disclosed, it will be appreciated that this has been shown by way of example only, and the invention is not to be limited thereto as other variations will be apparent to those skilled in the art and the invention is to be given its fullest possible interpretation within the terms of the following claims.

What is claimed is:

1. A spark gap component for use in ignition systems of internal combustion engines comprising:

a tubular insulator discharge tube;

a stepped beaker-shaped electrode formed having a first and a second offset, and a closed end portion disposed in each end of said discharge tube, said first offset interfacing with said tube end;

said electrodes being spaced from each other to define a discharge gap between opposing end portions and being disposed in the ends of said tube in a gas-tight manner and insulated from each other.

2. The spark gap component of claim 1 wherein the opposed end portions of said electrodes are provided with a layer of burn-resistant material.

3. The spark gap component of claim 1 wherein said tubular insulator is made of ceramic material.

4. The spark gap component of claim 2 wherein said tubular insulator is made of ceramic material.

5. The spark gap component of claim 1 wherein said gas-tight discharge tube is filled with an inert gas.

6. A spark plug connector comprising:

a tubular insulator body having an internal wall;

a contact terminal and a high voltage cable connector fixed within said tubular insulator body in longitudinally spaced relation to each other;

a spark gap component disposed within said tubular insulator body between said contact terminal and said high voltage cable connector, said spark gap component comprising:

a second tubular insulator discharge vessel;

a beaker-shaped electrode disposed in each end of said second tubular insulator;

said electrodes being spaced from each other to define a discharge gap therebetween and being fitted in the ends of said tube in a gas-tight manner;

said second tubular discharge vessel having an outer diameter substantially matched to the internal diameter of said tubular insulator body.

7. The spark plug connector of claim 6 wherein said electrode having a stepped-beaker configuration comprising a first offset, a second offset, a closed end portion and an inner annular shoulder defined between said first and second offsets, said discharge gap further defined by said closed end portion of said electrodes; and a connector component supported in said annular shoulder of said electrodes respectively.

* * * * *